United States Patent [19]

Gatti

[11] Patent Number: 4,653,401

[45] Date of Patent: Mar. 31, 1987

[54] SELF DESTRUCTING FUSE FOR SUB-MUNITIONS TO BE EXPELLED FROM A ROCKET

[75] Inventor: Antonio Gatti, Milan, Italy

[73] Assignee: Fratelli Borletti S.p.A., Italy

[21] Appl. No.: 867,937

[22] Filed: May 29, 1986

[30] Foreign Application Priority Data

Jun. 28, 1985 [IT] Italy ..... 67594 A/85

[51] Int. Cl.[4] ..... F42C 15/04

[52] U.S. Cl. ..... 102/226; 102/257; 102/489

[58] Field of Search ..... 102/226, 227, 223, 225, 102/228, 229, 230, 260, 489, 393, 388, 257

[56] References Cited

U.S. PATENT DOCUMENTS

| | | | |
|---|---|---|---|
| 2,498,043 | 2/1950 | Lauritson | 102/226 |
| 2,750,888 | 6/1956 | Wynn | 102/226 |
| 2,856,854 | 10/1958 | Bowersett et al. | 102/226 |
| 3,913,483 | 10/1975 | Wolterman | 102/226 X |
| 3,998,164 | 12/1976 | Hadfield | 102/226 |

*Primary Examiner*—David H. Brown

*Attorney, Agent, or Firm*—Jeffers, Irish & Hoffman

[57] ABSTRACT

The fuse comprises a first striker member which is movable within the body of the fuse and is able to come into contact with a detonator to cause it to explode, and a slide which is movable in a direction substantially orthogonal to that in which the striker member is movable and which carries the detonator; within the said slide there is disposed a second striker member which is movable from a first position, in which it elastically deforms a spring and is held at a predetermined distance from the detonator, to a second position in which it comes into contact with the detonator to cause it to explode, the movement of the second striker member being delayed by delay means operable to allow the movement of the striker member itself from the first-defined first to the second position only after a predetermined time.

5 Claims, 3 Drawing Figures

SELF DESTRUCTING FUSE FOR SUB-MUNITIONS TO BE EXPELLED FROM A ROCKET

BACKGROUND OF THE INVENTION

The present invention relates to a fuse for submunitions of the type which are carried by a projectile and are expelled from this to fall on the target.

Such sub-munitions are normally disposed within a suitable container housed in a projectile which is provided with an expulsion charge which is activated at a determined point of the trajectory of the projectile itself in such a way as to expel the sub-munitions; each of these, in the first part of the trajectory which starts after their expulsion, is given the same movement as has been imparted to the projectile and therefore, if this is constituted by a shell fired from a gun of conventional type, each sub-munition as well as following a predetermined trajectory, is also provided with a rotary motion substantially about its longitudinal axis.

The fuses of sub-munitions of the type indicated are normally provided with an arming device comprising a striker member movable substantially in the direction of its longtiudinal axis and a detonator carried by a slide movable from a first position, in which the said detonator is located out of the path of the striker member to a second position in which the detonator is, on the other hand, carried into the path of the member itself and beneath this. The striker member is movable from a first position in which it prevents the displacement of the said slide, to a second position in which it allows the displacement of the slide itself; for the purpose of generating the axial displacement of the striker member from the first to the second position first noted, this is normally provided with a threaded stem screwed into a corresponding threaded hole of a small bush movable axially within the body of the fuse, in such a way that the striker member can be brought from the first to the second position first defined following unscrewing of the threaded stem from the corresponding threaded hole. When the striker member is located in this second position the slide is displaced by the action of a spring from the first to the second position first defined and therefore the fuse is in its armed configuration in which the striker member is above the detonator and controls the explosion of the associated charge when, because of the striking of the sub-munition on the ground, the inertial force of the striker member itself thrusts this against the detonator.

In fuses of the type described, at the upper end of the striker member there is normally connected a flexible element of annular form which is normally folded in a pack above the fuse when the associated sub-munition is located within the projectile and which disposes itself in an open configuration because of the aerodynamic forces which act on it after the sub-munition has been ejected from the projectile. Since the sub-munition is given a rotary motion, and because of the aerodynamic resistance generated by the said flexible element, this latter tends to oppose the rotation of the sub-munition in this way giving rise to a moment on the striker member to which the flexible element is connected; the said moment generates a rotation of the striker member with respect to the body of the fuse, and therefore causes the unscrewing of the striker member itself from the corresponding threaded hole first mentioned, in such a way as to bring the striker member from the first position to the second position previously described.

Fuses of the type described have the disadvantage of not causing explosion of the detonator when the sub-munitions on which they are mounted fall on soft ground, for example snow covered ground, or reach the ground with a trajectory which forms a small angle therewith. In this case the sub-munitions lying on the ground can explode when struck inadvertently, in this way acting as a land mine which could cause serious danger to those who have themselves fires the sub-munitions.

There are known fuses which are fitted with devices operable to cause explosion of the associated sub-munitions a predetermined time after they have fallen on the ground; such devices comprise a striker member operable to come into contact with the detonator, the displacement of which is controlled by an assembly of mechanical members normally actuated by springs, in which there are provided delay means operable to allow the said displacement after a certain time from its activation.

Such devices have the disadvantage of being very complex overall and of low reliability; in fact, the members of the assembly first mentioned must be made with very strict tolerances and require delicate operations for their assembly, moreover, the operation of the delay means, normally based on the transfer of a suitable viscus fluid, is considerably influenced by the ambient conditions and is not reliable.

SUMMARY OF THE INVENTION

The object of the present invention is that of providing a fuse of the type indicated, which will be provided with a device operable to allow the destruction of the sub-munition on which it is mounted if this has not exploded upon coming into contact with the ground, and which will be free from the disadvantages mentioned above.

The said objects are achieved by means of a fuse for sub-munitions which can be ejected from a projectile, comprising a first striker member movable within the body of the fuse in the direcetion of its longitudinal axis to come into contact with a detonator to cause it to explode, a slide which is movable within the said body in a direction substantially orthogonally of that of the said axis and which carries the said detonator, the said slide being movable from a first position in which the said detonator is located out of the path of the said first striker member and to one side thereof, to a second position in which the said detonator is located in the said path, the said striker member being movable from a first position, in which the lower end thereof is inserted in a corresponding seating of the said slide to prevent its movement, to a second position in which the said end is withdrawn from the said seating, in such a way as to allow movement of the said slide, characterised by the fact that it includes a second striker member movable within the said slide from a first position, in which it resiliently deforms a spring and is held at a predetermined distance from the said detonator, to a second position in which it comes into contact, by the action of the said spring, with the said detonator to cause it to explode, the said second striker member being held in the said first position by the action of the said first striker member when the said slide is located in the said first position and the movement of the said second striker member being delayed by delay means operable to allow the movement of the said second striker member from the said first to the said second position after a predetermined time from the instant in which the said slide has reached the said second position.

BRIEF DESCRIPTION OF THE DRAWINGS

For a better understanding of the present invention there will now be given, by way of example, a more detailed description of it with reference to the attached drawings, in which.

DETAILED DESCRIPTION OF THE INVENTION

Figure 1:
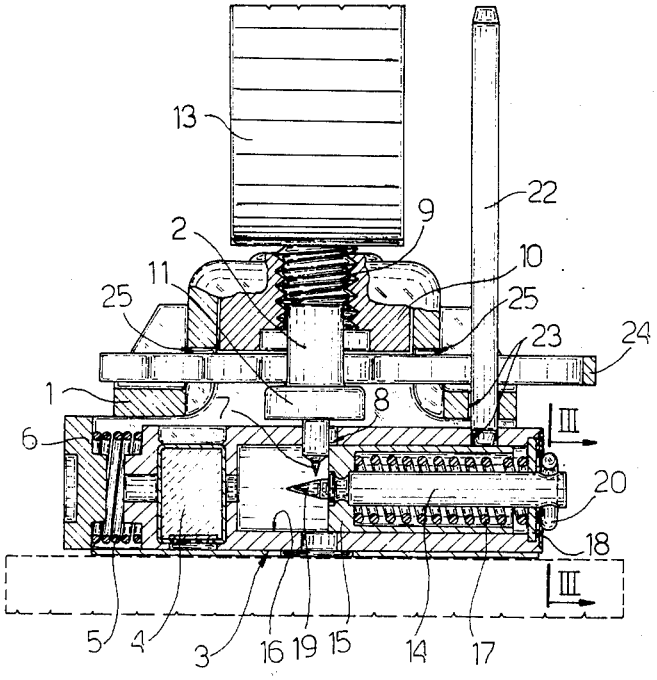
FIG. 1 is a section of a fuse of the invention in a first operative configuration.
Figure 3:
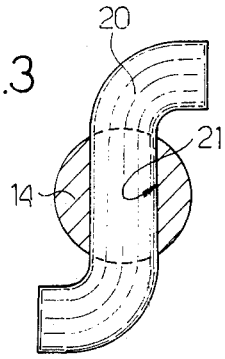
FIG. 3 is a section, on an enlarged scale, of the fuse of FIG. 1 taken on the line 3—3.

The fuse of the invention substantially comprises a body 1, a striker member 2 movable in the direction of its longitudinal axis within the body itself, and a slide 3 also movable with respect to the body in a direction substantially orthogonal to the preceding direction.

The slide 3 is provided with a housing in which is disposed a detonator 4 and which is positioned at one end of the slide itself; this slide is movable in a guide, formed in the body 1, under the action of a coil spring 5 interposed between an end surface of this and a suitable shoulder 6 formed on the body 1. This slide can be carried, by the action of this spring, from a first position represented in FIG. 1, in which the detonator 4 is located out of the path of the striker member 2 and to one side of this, to a second position, represented in FIG. 2, in which the detonator itself is in the path of the striker member and immediately beneath it.

The striker member 2 which is substantially in the form of a cylindrical rod, includes a, substantially conical tip 7 at the end thereof, which can exert a force on the detonator 4 to cause it to explode; this tip can be inserted into a corresponding hole 8 of the slide 3 when this is in the first-defined first position, for the purpose of locking it in this position, as is clearly seen in FIG. 1. The striker member 2 is provided with a threaded section 9 which, when the striker member is located in the above-defined first position, is screwed into a corresponding threaded hole of a small sleeve 10 which can move axially within the body 1 in the direction of the longitudinal axis of the striker member, but which is prevented from rotating with respect to it. At the upper end of the striker member 2 there is fixed a deformable element in the form of a strip 13 formed substantially in a loop, operable to cause rotation of the striker member 2 with respect to the body 1 of the fuse by aerodynamic action in a manner such as to cause, as will be described in more detail below, unscrewing of the threaded section 9 of the member itself from the corresponding threaded hole of the sleeve 10 to extract the tip 7 from the hole 8 in the slide 3. In the lower part of the striker member 2 there is formed an annular projection 11 which cooperates with a corresponding shoulder formed on the sleeve 10.

Within the slide 3 there is disposed a second striker member 14 which is movable axially with respect to the slide in a direction substantially orthogonal to that of the movement of the striker member 2; conveniently, this striker member is rigidly connected to a sleeve 15 movable within a corresponding hole 16 of the slide 3. The striker member 14 is thrust against the detonator 4 by the action of a coil spring 17 which is housed within the sleeve 15 between a shoulder of this and a suitable stop ring 18 fixed to the slide itself. The second striker member 14 is movable from a first position, shown in FIG. 1 and 2, in which it is held substantially at a predetermined distance from the detonator 4, to a second position in which a tip 19 of the striker itself comes into contact with the detonator 4 to cause it to explode.

As is clearly seen in FIG. 1, when the slide 3 is located in the first-defined first position, the tip 7 of the first striker member 2 also constitutes a stop against movement of the second striker member 14 since it engages the end surface of the sleeve 15.

Figure 2:
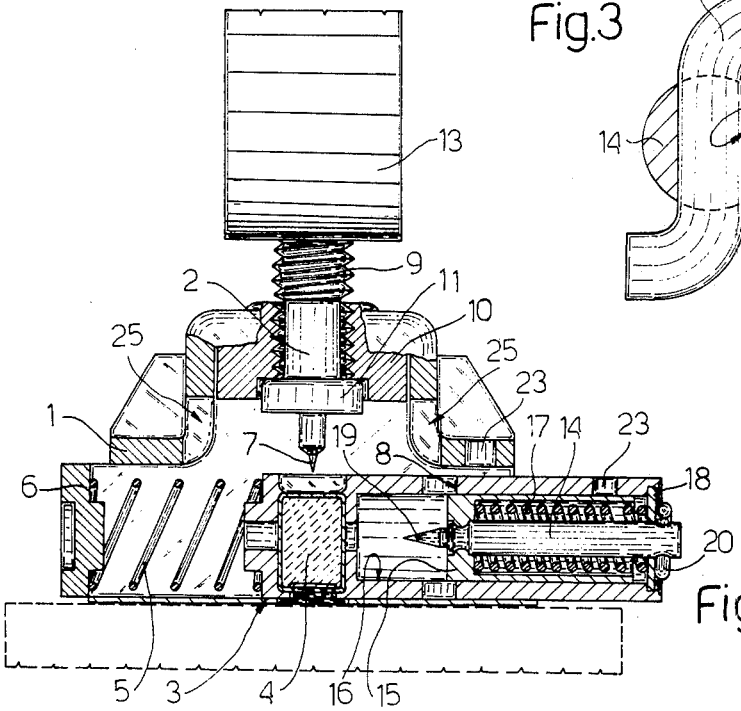
FIG. 2 is a section through the preceding Figure, in which the fuse has been shown in a second operative position.

The second striker member 14 is provided with delay means, operable to allow its movement from the first to the second position first defined after a predetermined time from the instant at which the tip 7 of the first striker member 2 has been withdrawn from the hole 8 to allow the slide 3 to reach the second position illustrated in FIG. 2.

This delay means conveniently comprises a stop member of the striker member 4, operable to lock it with respect to the slide for a predetermined time, after which this stop member frees the striker member to allow its movement under the action of the spring 17. Conveniently this stop member is constituted by a section 20 of a wire of material which has a high viscus flow such as for example lead, inserted into a corresponding hole 21 formed in the end part of the second striker member 14. This section of wire, as is clearly seen in the drawings, normally rests against the stop ring 18 in such a way as to prevent, for a predetermined time, any displacement of the sleeve 15 under the action of the spring 17.

Conveniently, the fuse of the invention includes a pin 22 which can be inserted in corresponding holes 23 formed in the body 1 and the slide 3 for the purpose of constituting a safety pin against displacement of the slide itself. Moreover, a cotter 24 can be inserted transversely into corresponding slots formed in the body 1 to prevent any axial displacement of the sleeve 10 and therefore to constitute a further safety stop.

The operation of the fuse described is as follows.

After the sub-munition has been separated, in a known way, from the projectile which carries it, the aerodynamic forces acting on it are able to put the fuse into its armed configuration; in fact, if the sub-munition, whilst it moves along its trajectory, is given a rotary movement about its longitudinal axis, the action of the aerodynamic resistance of the deformable element 13 causes unscrewing of the threaded section 9 of the first striker member 2 from the corresponding threaded hole in the sleeve 10, until the member itself is put in the configuration of FIG. 2 in which the annular projection 11 comes into contact with the corresponding stop surface of the sleeve.

In this configuration, as is clearly seen in FIG. 2, the tip 7 of the striker member 2 is withdrawn from the hole 8 in the slide and therefore this, under the action of the coil spring 5, is displaced from the first configuration shown in FIG. 1 into the second configuration shown in FIG. 2, in which the detonator 4 is located beneath the tip 7 of the first striker member 2 in the armed position.

When the sub-munition strikes the ground the inertia action which acts on the assembly constituted by the sleeve 10 and the striker member 2 creates a force to thrust the tip 7 against the detonator 4 to cause it to explode.

If these inertia forces are not sufficiently high to cause the explosion, as can happen if the sub-munition falls onto soft ground, for example snow covered ground, or the terminal part of its trajectory is not substantially orthogonal to the ground, the sub-munition is destroyed on the ground anyway by the action of the fuse of the invention.

In fact, starting from the instant in which the tip 7 of the first striker member has been withdrawn from the hole 8 of the slide 3, the sleeve 15 to which the second striker member 14 is rigidly connected is retained in the previously-defined first position (and corresponding to that of the Figure) solely by the action of the delay means with which the fuse is provided and which comprises the wire section 20. This, under the action of the force exerted by the spring 17, and because of the nature of the material of which it is made, is platically deformed in a continuous manner; this plastic deformation proceeds for a time which depends substantially on the section of the wire element 20 and the force exerted by the spring 17, and can therefore be suitably chosen. At the end of the said plastic deformation the wire element 20 is completely cut through, therefore freeing the sleeve 15 which can be moved to the end-of-stroke position, towards the left of FIG. 2 (a position which has not been shown) carrying the tip 19 against the detonator 4 to cause it to explode.

It is evident that the delay means which have been described, and which in the illustrated embodiment are constituted by the wire element 20, can be made in a different way and comprise a partly worked element of any other form which cooperates with the second striker member 14 in such a way as to constitute a stop for it and can be deformed substantially by viscus flow until the member itself is freed and allows the spring to move it to strike against the detonator 4.

Other modifications and variations, both as to form and to disposition of the various parts, can be introduced without departing from the scope of the invention.

I claim:

1. A fuse for sub-munitions which can be ejected from a projectile, comprising a first striker member movable within the body of the fuse in the direction of its longitudinal axis to come into contact with a detonator to cause it to explode, a slide which is movable within the said body in a direction substantially orthogonally of that of the said axis and which carries the said detonator, the said slide being movable from a first position in which the said detonator is located out of the path of the said first striker member and to one side thereof, to a second position in which the said detonator is located in the said path, the said striker member being movable from a first position, in which the lower end thereof is inserted in a corresponding seating of the said slide to prevent its movement, to a second position in which the said end is withdrawn from the said seating, in such a way as to allow movement of the said slide, characterised by the fact that it includes a second striker member movable within the said slide from a first position, in which it resiliently deforms a spring and is held at a predetermined distance from the said detonator, to a second position in which it comes into contact, by the action of the said spring, with the said detonator to cause it to explode, the said second striker member being held in the said first position by the action of the said first striker member when the said slide is located in the said first position and the movement of the said second striker member being delayed by delay means operable to allow the movement of the said second striker member from the said first to the said second position after a predetermined time from the instant in which the said slide has reached the said second position.

2. A fuse according to claim 1, characterised by the fact that the said delay means comprise a stop member for the said second striker member, operable to block the movement of the member itself with respect to the slide and under the action of the said spring, the said stop member being able to free the said second striker member to allow the movement thereof after the said predetermined time.

3. A fuse according to claim 1, characterised by the fact that the said second striker member is rigidly connected to a sleeve which is movable within a first hole of the said slide, having an axis coincident with the direction of movement of the slide itself, the said seat of the said slide in which the said end of the said first striker member is inserted being constituted by a second hole which is orthogonal to the said first hole and which is positioned in such a way as to be located on one side of the said sleeve when the said second striker member is in the said first position.

4. A fuse according to claim 2, characterised by the fact that the said stop member comprises a wire of material having a high viscus flow, which is inserted in a radial hole of the said second striker member and which abuts against a shoulder of the said slide, the said wire being able to be cut after the said predetermined time.

5. A fuse according to claim 4, characterised by the fact that the said wire is made of lead.

* * * * *